US010036251B2

(12) United States Patent
Sub et al.

(10) Patent No.: US 10,036,251 B2
(45) Date of Patent: Jul. 31, 2018

(54) FIBERGLASS ROOF AND RIB PLATE

(71) Applicant: FCI Holdings Delaware, Inc., Wilmington, DE (US)

(72) Inventors: Travis Mikel Sub, Butler, PA (US); John G. Oldsen, Butler, PA (US); Wallace Bolton, Harrogate, TN (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 841 days.

(21) Appl. No.: 13/774,119

(22) Filed: Feb. 22, 2013

(65) Prior Publication Data

US 2013/0236250 A1 Sep. 12, 2013

Related U.S. Application Data

(60) Provisional application No. 61/601,731, filed on Feb. 22, 2012.

(51) Int. Cl.
*E21D 21/00* (2006.01)
*E21D 17/01* (2006.01)

(52) U.S. Cl.
CPC ..... *E21D 17/01* (2013.01); *E21D 21/0006* (2013.01); *E21D 21/008* (2013.01); *E21D 21/0033* (2013.01); *E21D 21/0086* (2013.01)

(58) Field of Classification Search
CPC ... E21D 21/0086; E21D 11/34; E21D 15/502; E21D 20/00; E21D 21/00
USPC ..... 405/302.1, 288, 302.2, 302.4, 259.1, 405/259.2, 259.3
See application file for complete search history.

(56) References Cited

U.S. PATENT DOCUMENTS 2,854,824 A * 10/1958 Curry ..... E21D 21/0086 248/205.1
3,090,203 A * 5/1963 Durget ..... E21D 21/00 405/259.4
3,133,468 A * 5/1964 Cumming ..... E21D 21/02 411/11
3,224,202 A * 12/1965 Durget ..... E21D 21/0086 405/302.1
3,882,752 A * 5/1975 Gutshall ..... F16B 35/06 411/369
3,918,233 A * 11/1975 Simpson ..... E04B 7/105 52/536

(Continued)

FOREIGN PATENT DOCUMENTS

WO 2012083342 A1 6/2012
WO 2012167308 A1 12/2012
WO 2013028754 A1 2/2013

*Primary Examiner* — Benjamin F Fiorello
*Assistant Examiner* — Edwin J Toledo-Duran
(74) *Attorney, Agent, or Firm* — The Webb Law Firm

(57) ABSTRACT

A bearing plate and a nut and bolt arrangement for use as a rib or roof support for coal mines where the extracted coal is used for powder coal and has a specific gravity in the range of 1.5-1.9, preferably 1.7. The bearing plate has an outer reinforced area surrounding an inner reinforced area. The outer reinforced area has one or more endless rib members and the inner reinforced area has a plurality of legs, wherein the legs are spaced from one another and the first end of each leg encircles a bolthole in a center of the bearing plate to receive the bolt of the nut and bolt assembly. The bearing plate and the nut and bolt assembly are made of fiberglass reinforced plastic.

16 Claims, 12 Drawing Sheets

(56) References Cited

U.S. PATENT DOCUMENTS 4,037,418 A * 7/1977 Hannan ..... E21D 21/0086 405/302.1
4,095,431 A * 6/1978 Hannan ..... E02D 5/80 405/259.1
4,112,693 A * 9/1978 Collin ..... E21D 21/0086 405/132
4,183,699 A * 1/1980 Donan, Jr. ..... E21D 21/0086 277/640
4,188,158 A * 2/1980 Donan, Jr. ..... E21D 21/0026 405/259.3
4,275,975 A * 6/1981 Morgan ..... E21D 21/0046 405/259.3
4,371,293 A * 2/1983 Wilcox ..... E21D 21/0086 405/302.1
4,410,296 A * 10/1983 Unrug ..... E21D 21/02 405/259.1
4,498,815 A * 2/1985 Dye ..... E21D 21/0086 405/302.1
4,518,282 A * 5/1985 Wilcox ..... E21D 21/0086 405/302.1
4,652,178 A * 3/1987 Kates ..... E21D 21/0086 405/302.1
4,708,559 A * 11/1987 Locotos ..... F16B 43/00 405/259.1
4,747,241 A * 5/1988 Whitman ..... E04D 5/143 411/258
4,892,429 A * 1/1990 Giannuzzi ..... E04D 3/3603 411/383
D310,324 S * 9/1990 Bernacchi ..... D8/352
5,064,311 A * 11/1991 Giroux ..... E21D 21/0093 405/259.1
5,139,379 A * 8/1992 Hasan ..... E04D 3/3603 411/368
5,292,209 A * 3/1994 Calandra, Jr. ..... E21D 11/006 405/259.1
5,385,433 A * 1/1995 Calandra, Jr. ..... E21D 11/006 405/259.1
5,556,234 A * 9/1996 Oldsen ..... E21D 21/0086 405/259.1
5,628,587 A * 5/1997 Lesslie ..... E21D 21/0086 405/259.1
5,769,570 A * 6/1998 Stankus ..... E21D 21/0086 405/302.1
5,791,823 A * 8/1998 Blakley ..... E21D 21/0026 405/259.1
RE35,902 E * 9/1998 Calandra, Jr. ..... E21D 11/006 405/259.1
5,803,693 A * 9/1998 Choiniere ..... E04D 5/145 405/302.1
5,885,034 A * 3/1999 Fergusson ..... E21D 21/008 405/302.1
6,056,482 A * 5/2000 Calandra, Jr. ..... E21D 21/008 405/259.1
6,146,056 A * 11/2000 Calandra, Jr. ..... E21D 21/0086 405/288
6,682,268 B2 * 1/2004 Robertson, Jr. ..... E21D 21/0086 405/259.1
6,939,097 B2 * 9/2005 Carr ..... F16B 43/00 411/155
D576,480 S * 9/2008 Vakiener ..... D8/397
D596,934 S * 7/2009 Vakiener ..... D8/397
7,625,155 B1 * 12/2009 McKinney ..... E21D 21/008 405/259.1
8,052,353 B2 * 11/2011 Oldsen ..... E21D 21/0086 405/259.1
2001/0042267 A1 * 11/2001 Wilson ..... E04H 4/1236 4/508
2003/0039514 A1 * 2/2003 Tadolini ..... E21D 11/155 405/288
2004/0018062 A1 * 1/2004 Calandra, Jr. ..... E21D 11/155 405/288
2006/0210374 A1 9/2006 Calandra et al.
2006/0283099 A1 * 12/2006 Tumlinson ..... G09F 15/0006 52/38
2007/0036617 A1 * 2/2007 Oldsen ..... E02D 5/80 405/302.1
2007/0231084 A1 * 10/2007 Price ..... E21D 21/0026 405/288
2009/0003940 A1 * 1/2009 Oldsen ..... E02D 5/80 405/288
2010/0092250 A1 * 4/2010 Louie ..... E21D 21/0086 405/302.1
2011/0052332 A1 3/2011 Oldsen et al.
2011/0268526 A1 11/2011 Wu et al.
2012/0227389 A1 * 9/2012 Hinderks ..... F01B 1/10 60/317
2012/0251245 A1 * 10/2012 Spearing ..... E21D 21/008 405/302.2
2014/0099167 A1 * 4/2014 Zeitler ..... E21D 21/008 405/259.1

* cited by examiner

FIBERGLASS ROOF AND RIB PLATE

CROSS-REFERENCE TO RELATED APPLICATION

This application claims the benefits of U.S. Provisional Patent Application No. 61/601,731, filed Feb. 22, 2012, and titled "Fiberglass Roof and Rib Plate", which application is incorporated herein by reference in its entirety.

BACKGROUND OF THE INVENTION

Field of the Invention

The present invention generally relates to a fiberglass reinforced mine roof and rib plate, and nut and bolt assembly, and, more particularly, to a fiberglass reinforced mine roof and rib plate, and nut and bolt assembly having a density greater than the density of the coal to which the plate and bolt are mounted or are to be mounted.

Description of Related Art

As is appreciated by those knowledgeable in the art, the use of electricity has been an essential part of the economy of the United States. More particularly, coal burning produces about 55% of the electricity generated in the U.S. In one use, the coal is in the form of powder and is known as "powdered coal" or "coal dust" because it is as fine as face powder in cosmetic makeup. The concept of burning coal that has been pulverized into fine powder stems from the belief that if coal is made fine enough, it will burn almost as easily and efficiently as a gas.

In general, the process of making powdered coal includes removing the coal from the earth, conveying the coal to equipment to crush the coal into smaller chunks, and conveying the chunks of coal to a washing station to wash the coal, and grinding the washed coal chunks into powered coal. In one washing station of particular interest in the present discussion, but not limiting thereto, the coal chunks are fed into a large liquid-filled tank. The coal floats to the surface while the impurities, e.g. but not limited thereto, sulfur and pieces of support safety devices used in the mine, float to the bottom. As is appreciated by those skilled in the art, the liquid has a density greater than the density of the coal and a density less than the densities of the impurities.

Although the process of cleaning the coal by washing is acceptable, there are limitations. More particularly, the coal is removed from the mines by grinding the coal from the roof and the sidewalls or ribs. During the grinding operation, any support safety devices mounted in or on the wall and roof of the mine are ground or shredded. The support safety devices are usually made of metal, e.g. but not limited to, steel, and the grinding of the safety devices generates metal pieces having sharp edges that cut into the conveyor belts of the conveyor equipment.

The support safety devices of interest in the present discussion, but not limited thereto, include the roof and rib (sidewall) plates, and nut and bolt assemblies holding the plates in position ("support systems") that are used to provide surface control of mine roof and sidewalls. The surface control devices are made of metal to provide adequate stiffness characteristics that can help reduce or even eliminate progressive roof and rib failures. Mine roof and rib controls are typically managed by drilling a bore hole in a mine roof or sidewall, installing a first end of a mine roof bolt in the bore hole, positioning a channel, bearing plate, or mat adjacent to a second end of the mine roof bolt, mounting a nut on the second end of the bolt, securing the second end portion of the bolt in the roof or sidewall, and tightening the bolt to bias the channel plate, bearing plate, or mat against the rib or roof of the mine as the case may be. FIG. 16 herein shows a bearing plate of the invention biased against a roof of a mine.

Channel plates, bearing plates, roof channels, and mats help to further stabilize mine roof or rib strata, which may shift over time and can be a visual indicator that the mine roof bolts have been installed correctly. Of particular interest in the present discussion are rib plates used to stabilize the ribs and roof of coal mines until such time that the coal forming the ribs and roof is removed. More particularly, the coal forming the ribs and roof is removed using a rotating drum having an abrading surface. The drum is rotated and biased against the rib and roof to abrade the coal from the ribs and roof of the mine. The usual practice is to leave the rib and roof plates in position and abrade the coal, the plates, and the bolts.

One of the advantages of having the support safety devices made of metal is that metal has a density greater than the density of coal and sinks to the bottom of the liquid tank during the washing of the coal. One drawback of having the support safety devices made of metal is damage to the conveyors as discussed above. Another drawback is that during the abrading of the sidewall, metal particles are pressed into coal chunks and remain on the coal chunks as they pass through and exit the washing station. When the metal particles are ground with the coal chunks, the particles mix with the powdered coal and clog the powdered coal feed jets of the furnace causing a furnace shut down to clean the jets.

As can be appreciated, it would be advantageous to provide safety support devices that do not have the limitations of the presently available safety support devices discussed above.

SUMMARY OF THE INVENTION

The invention relates to a bearing plate having a first major surface and an opposite second major surface. The bearing plate comprises an outer reinforced area surrounding an inner reinforced area, wherein the outer reinforced area comprises one or more endless rib members between the inner reinforced area and peripheral edge of the bearing plate. The inner reinforced area comprises a plurality of legs, each leg having a first end and an opposite second end spaced from the first end, wherein the legs are spaced from one another and the first end of each leg encircles a bolthole in a center of the bearing plate, and wherein the first end is at a higher elevation than the second end of the legs when measured from the first surface of the bearing plate.

The invention further relates to a nut and bolt assembly. The nut and bolt assembly comprises a nut made of fiberglass reinforced plastic and a bolt made of a core of fiberglass reinforced plastic, and a molded fiberglass reinforced plastic coating over the core.

Further, the invention relates to a bearing plate having a first major surface and an opposite second major surface. The bearing plate comprises an outer reinforced area surrounding an inner reinforced area, wherein the outer reinforced area comprises one or more endless rib members between the inner reinforced area and peripheral edge of the bearing plate. The inner reinforced area comprises a plurality of circular steps having a concentric center, wherein selected ones of the steps have a first plurality of cavities and a second plurality of cavities, wherein the first plurality of cavities has an open end at the first side of the bearing plate and the second plurality of cavities has an open end at the second surface of the bearing plate, and each one of the first cavities is between two adjacent ones of the second plurality of cavities.

DESCRIPTION OF THE PREFERRED EMBODIMENTS

Figure 1A:
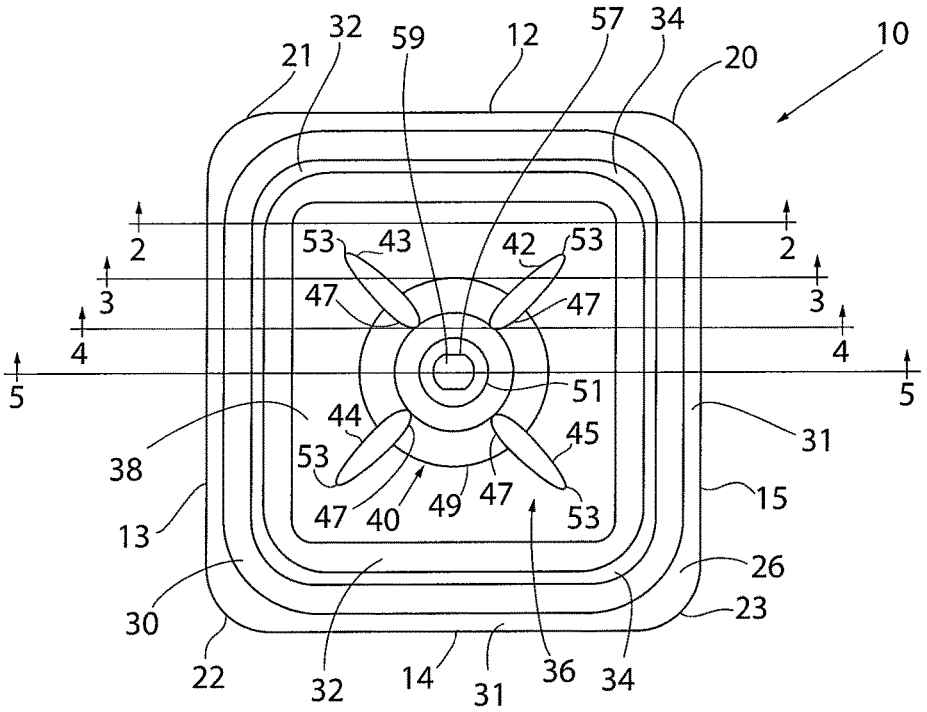
FIG. 1A and FIG. 1B, except for the numbering, are identical and presented on separate sheets of the drawings for ease of understanding the cross-sectional view on the drawing sheet having FIGS. 1A and 1B.
Figure 2:
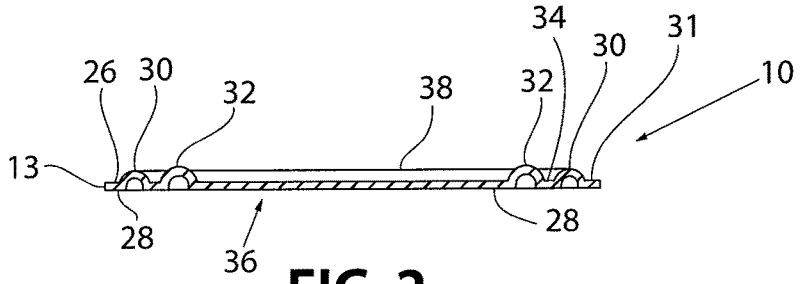
FIGS. 2, 3, 4, and 5 are cross-sectional views taken along the lines 2-2, 3-3, 4-4, and 5-5, respectively, of FIGS. 1A and 1B.
Figure 3:
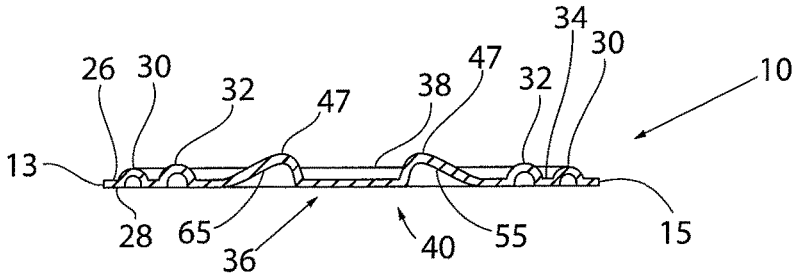

As used herein, spatial or directional terms such as "inner", "outer", "left", "right", "up", "down", "horizontal", "vertical", and the like, relate to the invention as it is shown in the drawing on the figures. However, it is to be understood that the invention can assume various alternative orientations and, accordingly, such terms are not to be considered as limiting. Further, all numbers expressing dimensions, physical characteristics, and so forth, used in the specification and claims are to be understood as being modified in all instances by the term "about". Accordingly, unless indicated to the contrary, the numerical values set forth in the following specification and claims can vary depending upon the property desired and/or sought to be obtained by the present invention. At the very least, and not as an attempt to limit the application of the doctrine of equivalents to the scope of the claims, each numerical parameter should at least be construed in light of the number of reported significant digits and by applying ordinary rounding techniques. Moreover, all ranges disclosed herein are to be understood to encompass any and all subranges subsumed therein. For example, a stated range of "1 to 10" should be considered to include any and all subranges between and inclusive of the minimum value of 1 and the maximum value of 10; that is, all subranges beginning with a minimum value of 1 or more and ending with a maximum value of 10 or less, e.g., 1 to 6.7, or 3.2 to 8.1, or 5.5 to 10. Also, as used herein, the term "positioned over" or "mounted over" means positioned on or mounted over but not necessarily in contact with the surface. For example, one article or component of an article "mounted over" or "positioned over" another article or component of an article does not preclude the presence of materials between the articles, or between components of the article, respectively.

Before discussing several non-limiting embodiments of the invention, it is understood that the invention is not limited in its application to the details of the particular non-limiting embodiments shown and discussed herein since the invention is capable of other embodiments. More particularly, the discussion is directed to non-limiting embodiments of sidewall or rib plates, and roof or sidewall nut and bolt assemblies for mounting the plates to the roof and sidewalls; the invention, however, is not limited thereto, and the plates of the invention can be used with any type of nut and bolt assemblies, and/or the nut and roof bolt assemblies of the invention can be used with any type of rib and roof plate. Further, the terminology used herein to discuss the invention is for the purpose of description and is not of limitation. Still further, unless indicated otherwise, in the following discussion like numbers refer to like elements.

When used on the roof and/or sidewalls of a mine, the plate and/or nut and bolt assembly of the invention assists to prevent various forms of roof and/or rib collapse. When used on the ribs (sidewalls), the plate and/or nut and bolt assembly of the invention assists to prevent rib roll, which is a condition where portions of the rib break out and can endanger the miners. The plates and/or nut and bolt assemblies can also be used at track entryways. Because of these various advantages, the plates, and nut and bolt assemblies of the invention can be used in coal mining as well as other various mining operations, e.g., hard rock mining.

Non-Limiting Embodiments of the Roof and Rib Plates of the Invention

Non-Limiting Embodiment Number One

With reference to FIGS. 1-5, as needed, there is shown a non-limiting embodiment of a roof and rib plate (hereinafter also referred to as a "bearing plate") 10 of the present invention. The bearing plate 10 was constructed and, in this non-limiting embodiment of the invention, the bearing plate 10 was a square bearing plate. However, the invention is not limited thereto and the plate 10 can have any configuration, e.g. but not limited to, a rectangular shape, a circular shape (see FIG. 15), an elliptical shape, or a trapezoidal shape. The plate 10 in this non-limiting embodiment of the invention had sides 12, 13, 14, and 15 each having any desired length, e.g. but not limited to, 18 inches, having radiused corners 20, 21, 22, and 23 to avoid pointed corners, which are a safety concern and having any desired thickness, e.g. but not limited to, 0.08 inch. The plate 10 included a first major surface 26 and an opposite second major surface 28 (see FIG. 2). With the plate 10 mounted on the rib or roof of the mine, the surface 28 of the bearing plate 10 is in facing relationship to the rib or the roof of the mine.

The plate 10 included an outer rib member 30 spaced from adjacent ones of the sides 12-15 by a flat surface portion 31, and spaced from an inner rib member 32 by a flat surface portion 34. Each of the rib members 30 and 32 on the first surface 26 of the plate 10 had a convex surface (see FIG. 2) and on the second surface of the plate 10 has a concave surface. Each of the rib members 30 and 32 are endless. As used herein, the term "endless" means that the rib members have no physical ends and are continuous, as in a circle. The invention is not limited to the size or number of rib members and any size or number needed to prevent a sidewall or roof collapse can be used in the practice of the invention.

In one non-limiting embodiment of the invention, the rib members 30 and 32 had a radius of 0.50 inch measured at the second surface 28 of the plate 10. The center of the outer rib member 30 is spaced 1.12 inches from the adjacent one of the sides 12-15, e.g., the side 12 of the plate 10, and the rib members 30 and 32 are on a center-to-center spacing of 1.47 inches. The inside rib member 32 circumscribed an inner portion 36 having a flat surface portion 38 surrounding a strengthened center portion or segment 40 of the plate 10. As viewed from the first surface 26, the strengthened center portion 40 included a plurality, e.g., four, spaced elongated legs 42, 43, 44, and 45. Each leg 42-45 has an end portion 47 formed into a sloping surface 49 (see FIGS. 1 and 4). The sloping surface 49 started at the flat inner portion 36 and slopes upward to terminate at flat circular portion 51. Opposite end portion 53 of the legs 42-45 was formed into the flat surface portion 38 surrounding the strengthened center portion 40 of the plate 10. Each of the legs 42-45, as viewed from the second surface 28 of the plate 10, has a convex surface 55 (see FIG. 3).

Figure 1B:
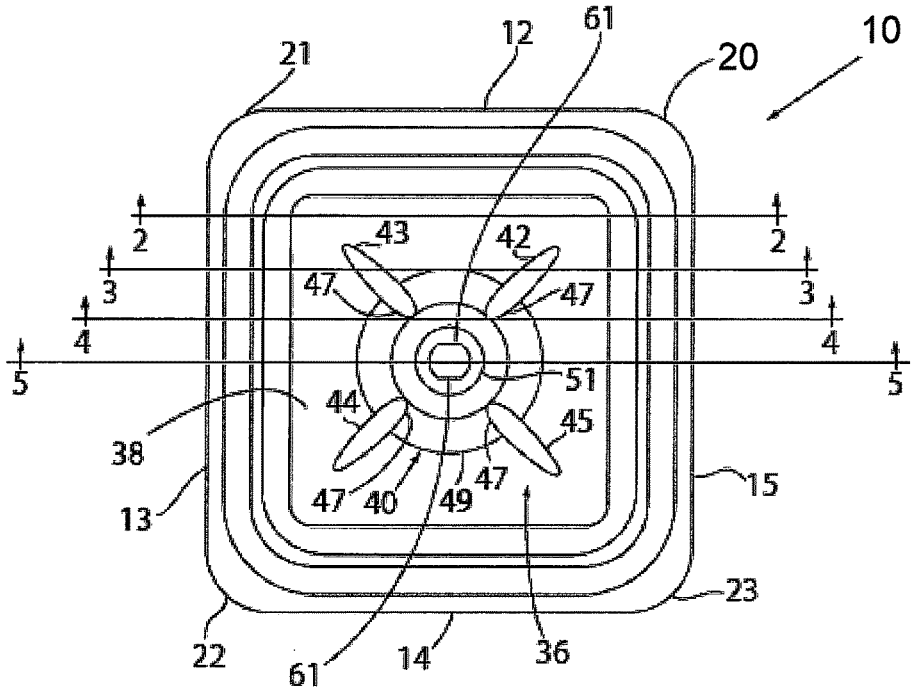
Figure 4:
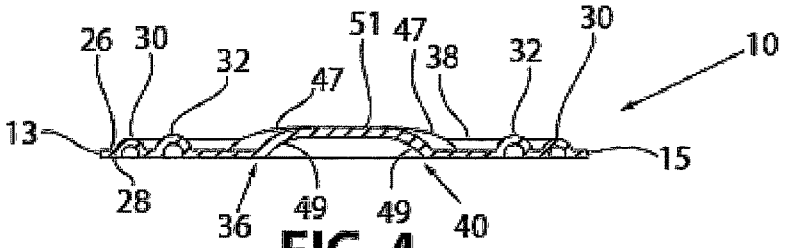
Figure 5:
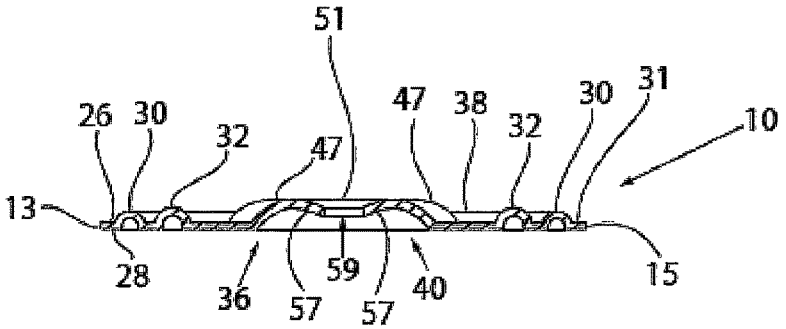

With continued reference to FIGS. 1A and 1B, the elevated flat circular portion 51 surrounds and is continuous with a cavity 57 having a hole 59 (see FIG. 5) to receive a nut and bolt arrangement to secure the plate 10 to the rib or roof in a manner discussed below. The shape of the hole 59 is not limiting to the invention but should be large enough to seat the surface 28 of the plate 10 against the surface of the rib or roof through a range of angles subtended by the bolt and plate. In one non-limiting embodiment of the invention, the hole 59 has a generally rectangular shape with sides 61 (numbered only in FIG. 1B) having a length of 1.044 inches and a spaced distance from one another of 1.250 inches.

The depth of the cavity 57 and the height of the flat circular portion 51 as measured from the flat surface portion 38 are preferably equal to one another such that all of the flat portions of the surface 28 of the plate 10 generally lie in the same plane.

Non-Limiting Embodiment Number Two

Shown in FIGS. 6-9 is another non-limiting embodiment of roof and rib plate (hereinafter also referred to as "bearing plate") of the invention designated by the number 80. The bearing plate 80 was constructed and, in this non-limiting embodiment of the invention, the bearing plate 80 is a square bearing plate. However, the invention is not limited thereto and the plate 80 can have any configuration, e.g. but not limited to, a rectangular shape, a circular shape, an elliptical shape, or a trapezoidal shape. The bearing plate 80 includes the sides 12-15, the radiused or rounded corners 20-23, the outer rib member 30, the inner rib member 32, the flat surface portion 31 between the sides 12-15 and the outer rib member 30, and the flat surface portion 34 between the outer and inner rib members 30 and 32, and the flat surface portion 38 between the inner rib member 32 and a strengthened center portion or segment 82 incorporating features of the invention.

Figure 7:
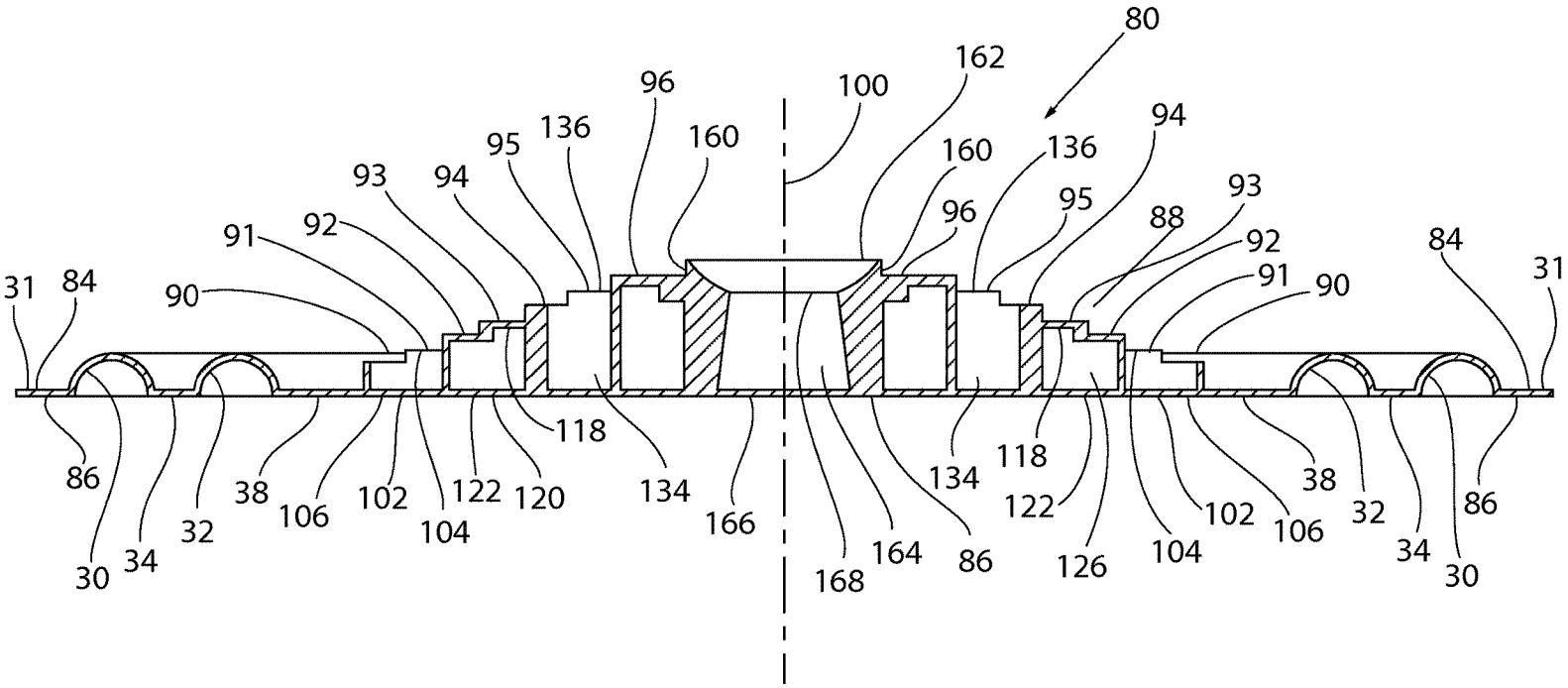
FIG. 7 is a cross-sectional view taken along lines 7-7 of FIG. 6.

The plate 80 included a first major surface 84 and an opposite second major surface 86 (see FIG. 7). With the plate 80 mounted on the rib or roof of the mine, the surface 86 of the bearing plate 80 is in facing relationship to the rib or the roof of the mine.

The strengthened center portion or segment 82 of the plate 80 included a plurality of circular steps, e.g. but not limited to, seven circular steps 90-96 having a concentric axis 100. In one non-limiting embodiment of the invention, the step 90 has a height of 0.33 inch, the step 91 has a height of 0.45 inch, the step 92 has a height of 0.78 inch, the step 93 has a height of 0.90 inch, the step 94 has a height of 1.125 inches, the step 95 has a height of 1.23 inches, and the step 96 has a height of 1.57 inches. The height of each step was measured from the flat surface portion 38.

The step 90 has an outside diameter of 10 inches; the step 91 had an outside diameter of 9 inches; the step 92 has an outside diameter of 8 inches; the step 93 has an outside diameter of 7.2 inches; the step 94 has an outside diameter of 6.5 inches; the step 95 has an outside diameter of 5.4 inches; and the step 96 has an outside diameter of 4.5 inches. With continued reference to FIGS. 5-9 as needed, each of the steps 91, 93, 95, and 96 as viewed from the surface 84 of the plate 80 had a first plurality of cavities, with the cavities of the steps 91, 93, and 94 extending to the adjacent lower step 90, 92, and 94, respectively. Each of the steps 91, 93, 95, and 96 as viewed from the surface 86 of the plate 80 (see FIGS. 7 and 8) had a second plurality of cavities, with the cavities of the steps 91, 93, and 94 extending to the adjacent lower step 90, 92, and 94, respectively.

Figure 8:
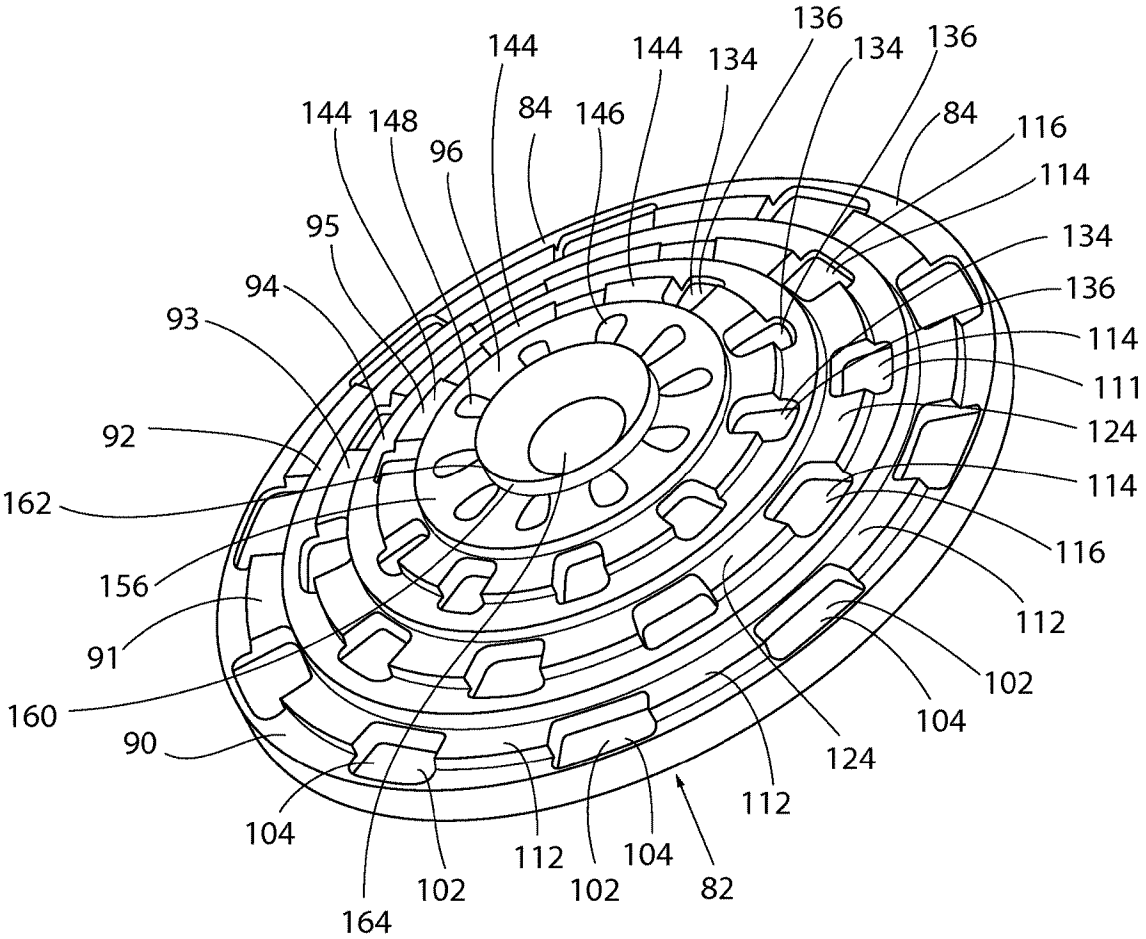
FIG. 8 is an isometric view of a top surface of a strengthened center portion or segment of the plate shown in FIG. 6.
Figure 9:
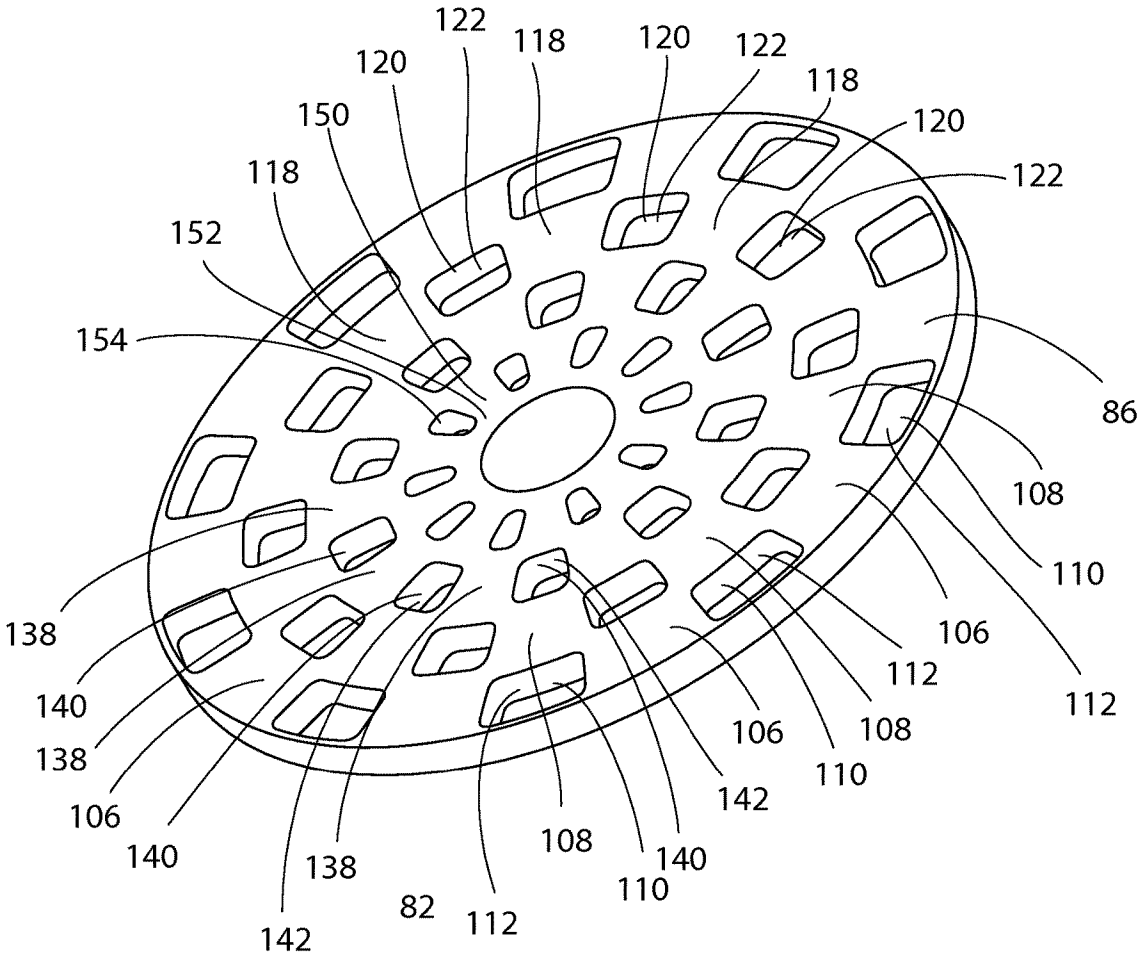
FIG. 9 is an isometric view of a bottom surface of the strengthened center portion or segment of the plate shown in FIG. 6.

With reference to FIGS. 8 and 9 as needed, in one non-limiting embodiment of the invention, the first plurality of cavities of the step 91 includes ten equally spaced cavities designated by the number 102 and having open end 104 at the surface 84 of the plate 80, and closed end 106 at the surface 86 of the plate 80, and the second plurality of cavities of the step 91 includes ten equally spaced cavities designated by the number 108 and having open end 110 at the surface 86 of the plate 80, and closed end 112 at the surface 84 of the plate 80. Each of the cavities 102 is between two adjacent cavities 108, and each of the cavities 102 and 108 has the same dimensions.

In the non-limiting embodiment of the invention under discussion, the first plurality of cavities of the step 93 includes ten equally spaced cavities designated by the number 114 and having open end 116 at the surface 84 of the plate 80, and closed end 118 at the surface 86 of the plate 80, and the second plurality of cavities of the step 93 includes ten equally spaced cavities designated by the number 120 and having open end 122 at the surface 86 of the plate 80, and closed end 124 at the surface 84 of the plate 80. Each of the cavities 114 is between two adjacent cavities 120, and each of the cavities 114 and 120 has the same dimensions.

Further, in the non-limiting embodiment of the invention under discussion, the first plurality of cavities of the step 95 included ten equally spaced cavities designated by the number 134 and having open end 136 at the surface 84 of the plate 80, and closed end 138 at the surface 86 of the plate 80, and the second plurality of cavities of the step 93 includes ten equally spaced cavities designated by the number 140 and having open end 142 at the surface 86 of the plate 80, and closed end 144 at the surface 84 of the plate 80. Each of the cavities 134 is between two adjacent cavities 140, and each of the cavities 134 and 140 has the same dimensions. The wall spacing between the first plurality of cavities and the second plurality of cavities is not limiting to the invention and is selected to provide the desired strength. As shown in FIGS. 6-9 and discussed above, the cavities 102 and 108 of step 91 extend into the adjacent lower step 90, the cavities 114 and 120 of the step 93 extend into the adjacent lower step 92, and the cavities 134 and 140 of the step 95 extend into the adjacent lower step 94.

Figure 6:
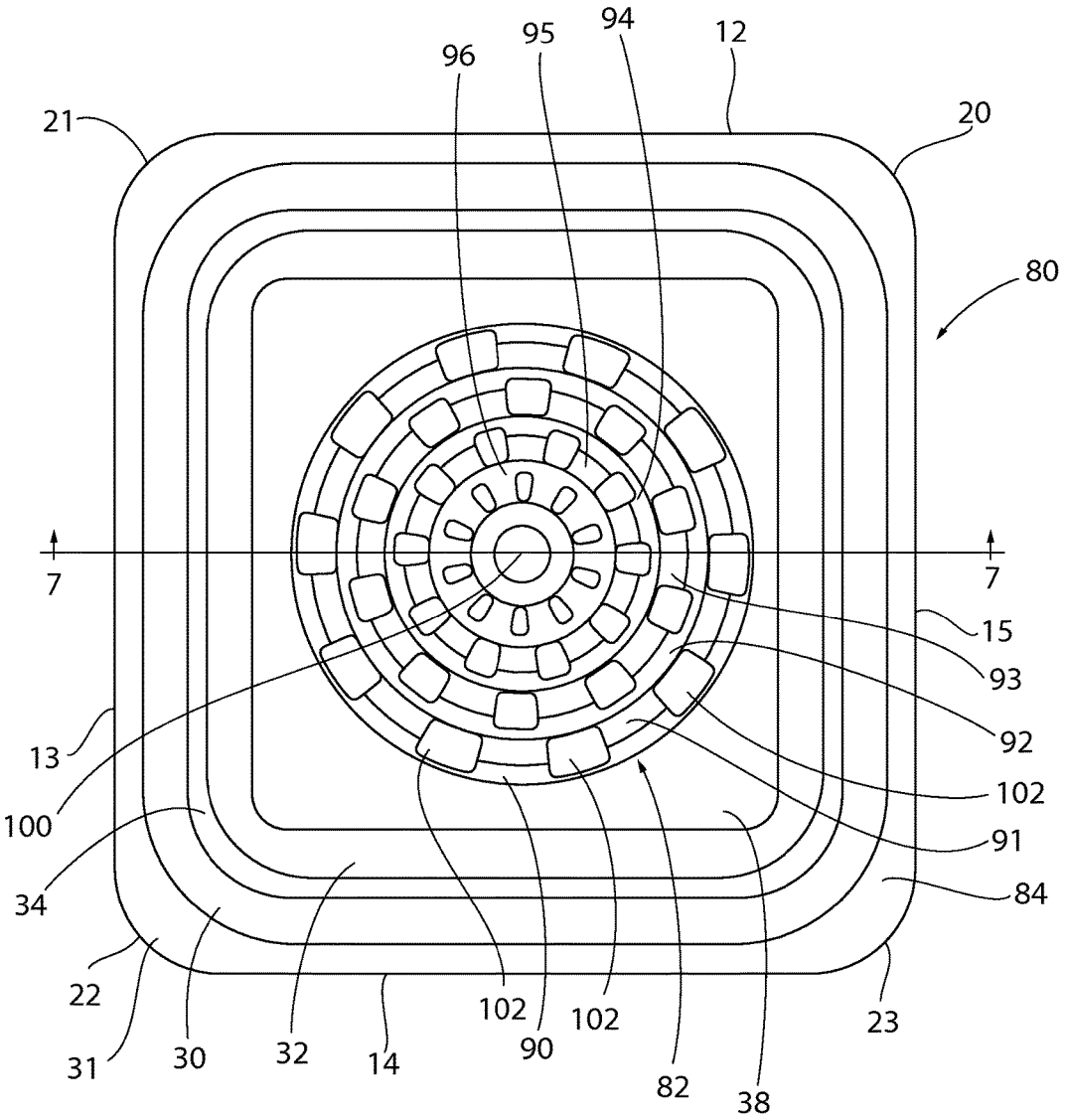
FIG. 6 is an elevated plan view of another non-limiting embodiment of a rib or sidewall and roof plate of the invention.

With continued reference to FIGS. 6-8, the first plurality of cavities for the step 96 includes ten equally spaced cavities designated by the number 146 and having open end 148 at the surface 84 of the plate 80, and closed end 150 at the surface 86 of the plate 80, and the second plurality of cavities of the step 96 includes ten equally spaced cavities designated by the number 152 and having open end 154 at the surface 86 of the plate 80, and closed end 156 at the surface 84 of the plate 80. Each of the cavities 146 is between two adjacent cavities 152, and each of the cavities 146 and 152 has the same dimensions. The cavities 146 and 152 of the step 96 do not extend to the adjacent lower step 95 as do the cavities of the steps 91, 93, and 95.

With reference to FIG. 7, the step 96 had a circular riser 160 having a height of 1.625 inches measured from the flat surface portion 38 to form first end 162 of a bolthole 164. The bolthole 164 has a circular opening at the first end 162 at the surface 84 of the plate 80 and an opposite second end 166 at the surface 86 of the plate 80. The thickness of the plate 80 at the center line or axis 100 of the circular steps 90-96 for the non-limiting embodiment of the invention under discussion is 1.733 inches. The first end 162 of the bolthole 164 has a diameter of 4.5 inches at the surface 84 of the plate 80. The bolthole 164 has a semi-spherical cavity for a distance of 0.44 inch measured from the first end 162 toward the second end 166 of the bolthole 164 designated as a transition position 168. At the transition position 168, the bolthole 164 has a diameter of 1.37 inches. The bolthole 164 from the transition position 168 to the second end 166 of the bolthole 164 had a conical hole having an increasing diameter and at the second end has a diameter of 1.69 inches.

Attachment 1 of U.S. Provisional Patent Application No. 61/601,731 filed Feb. 22, 2012 discloses additional details of the non-limiting embodiment of the bearing plate 80 shown in FIGS. 6-9. Attachment 1 is incorporated herein by reference.

Non-Limiting Embodiment Number Three

Shown in FIGS. 10-14 is a preferred non-limiting embodiment of a roof and rib plate (hereinafter also referred to as "bearing plate") of the invention designated by the number 180. The bearing plate 180 was constricted and, in this non-limiting embodiment of the invention, the bearing plate 180 was a square bearing plate. However, the invention is not limited thereto and the plate 180 can have any configuration, e.g. but not limited to, a rectangular shape, a circular shape, an elliptical shape, or a trapezoidal shape. The bearing plate 180 included the sides 12-15, the corners 20-23, the outer rib member 30, the inner rib member 32, the flat surface portion 31 between the sides 12-15 and the outer rib member 30, the flat surface portion 34 between the outer and inner rib members, and the flat surface portion 38 between the inner rib member 32 and a strengthened center portion 182 incorporating features of the invention.

Figure 11:
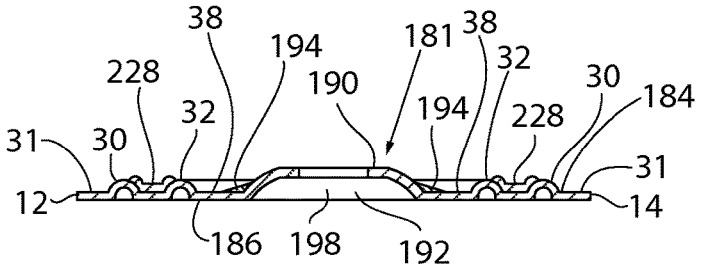
FIG. 11 is a view taken along line 11-11 of FIG. 10.
Figure 12:
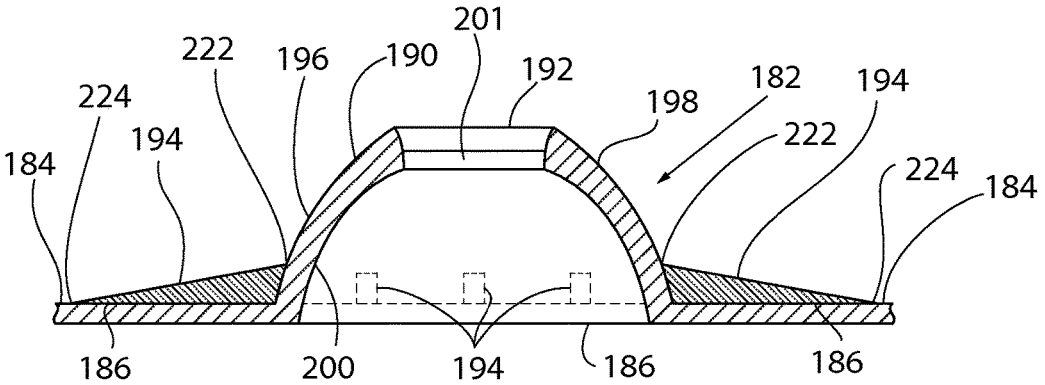
FIG. 12 is an enlarged view of the center portion of the cross section shown in FIG. 11.

The plate 180 included a first major surface 184 and an opposite second major surface 186 (see FIGS. 11 and 12). With the plate 180 mounted on the rib or roof of the mine, the second major surface 186 of the bearing plate 180 is in facing relationship to the rib or the roof of the mine. In one non-limiting embodiment of the invention, the bearing plate 180 had a thickness in the range of 0.080 inch+0.020/−0.01 inch; each of the sides 12-15 had a length of 14 inches measured along a straight line; each of the corners 20-23 had a radius of 4 inches; the flat surface portion 31 had a width of ⅝ inch as measured between the adjacent one of the sides 12-15 and the outer rib member 30; the flat surface portion 34 had a width of ⅝ inch as measured between the outer rib member 30 and the inner rib member 34.

The outer and inner rib members 30 and 32, respectively, each had a convex shape viewed from the first major surface 184 of the plate 180 (see FIGS. 10-14), and a concave shape viewed from the second major surface 186 (see FIGS. 11, 13, and 14), and the concave surface of the first and the second rib members 30, 32 each have a diameter of ⅞ inch.

Figure 10:
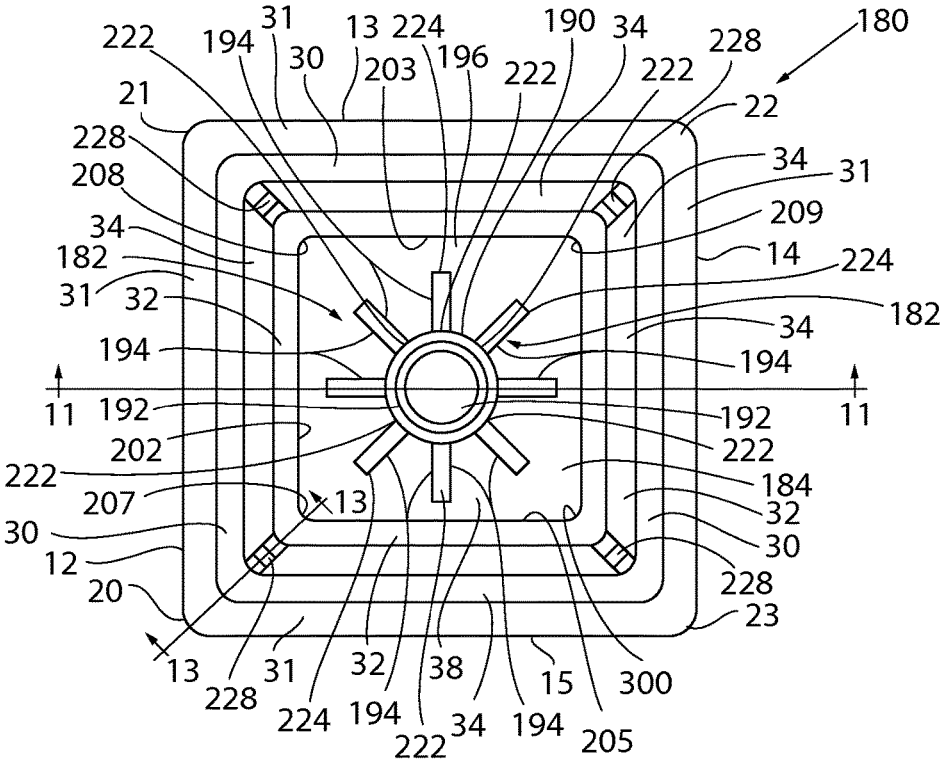
FIG. 10 is an elevated plan view of still another non-limiting embodiment of a rib or sidewall and roof plate of the invention.

With reference to FIGS. 10, 11, and 12 as needed, the strengthened center portion or segment 182 of the plate 180 includes a hemispherical-shaped member 190 having a hole 192 and a plurality of spaced reinforcement members 194. The hemispherical-shaped member 190 had a convex shape 198 viewed from the first major surface 184 (see FIG. 11) and a concave shape or surface 200 viewed from the second major surface 186 (see FIG. 11). In one non-limiting embodiment of the invention, the concave shape 200 of the hemispherical member 192 had a diameter of 4 inches measured at the second major surface 186 of the plate 180, and the hole 192 of the hemispherical member 190 had a diameter of 2½ inches measured at the first major surface 184 of the plate 180, and the hemispherical member 190 extends 2 inches above the first major surface 184 of the bearing plate 180. The concave surface 200 of the hemispherical member 190 from the first major surface 184 toward the second major surface 186 had a decreasing diameter to a diameter of 2 inches. The concave surface 200 of the hemispherical member 192 is a constant size (the area 201 shown in FIG. 12) for a distance of 0.070 inches and thereafter the diameter of the concave surface 200 of the hemispherical member 190 increases as the distance from the area 201 increases to the diameter of 4 inches measured at the second major surface 186.

As mentioned above, the flat portion 38 (see FIGS. 10 and 11) extended from the inner rib member 34 to the hemispherical member 192. In one non-limiting embodiment of the invention, the flat portion 38 has four sides 202-205 and four radiused corners 207-210. In one non-limiting embodiment of the invention, the sides 202-205 measured along a straight line had a length of 10.25 inches, and the corners 207-210 have a radius of 0.50 inch. Eight equally spaced reinforcement members 194 were provided. A first end 222 of the reinforcement members 194 is joined to the hemispherical member 192 (see FIG. 12) and opposite second end 224 of the reinforcement member 194 blends into the flat portion 38 as shown in FIG. 12. The first ends 222 of the reinforcement members 194 were at a position on the hemispherical member 192 such that the first ends 222 of the reinforcement members 194 lie in a circle having a diameter of 3.5 inches. The second ends 224 of the reinforcement members 194 blend into the surface of the flat portion 38 such that the second end 224 of the reinforcement members 194 lie in a circle having a diameter of 5 inches. The reinforcement members 194 have a width of 0.25 inch and a length of 3 inches.

Figure 13:
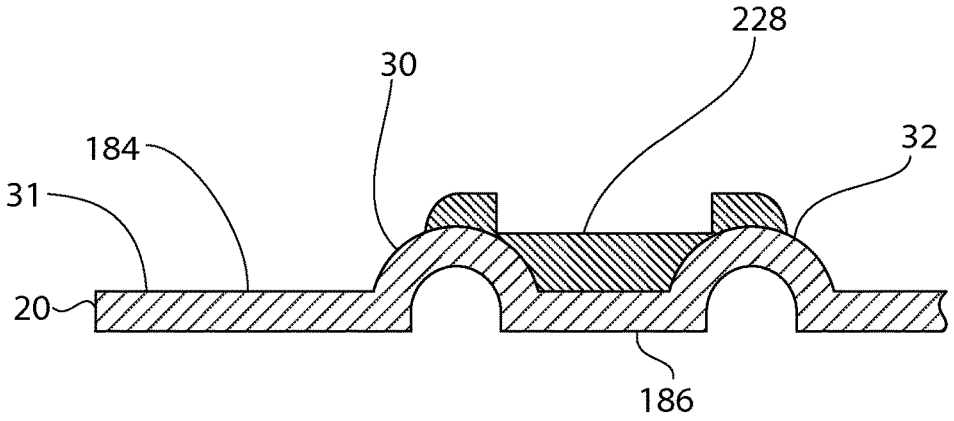
FIG. 13 is a view taken along line 13-13 of FIG. 10.
Figure 14:
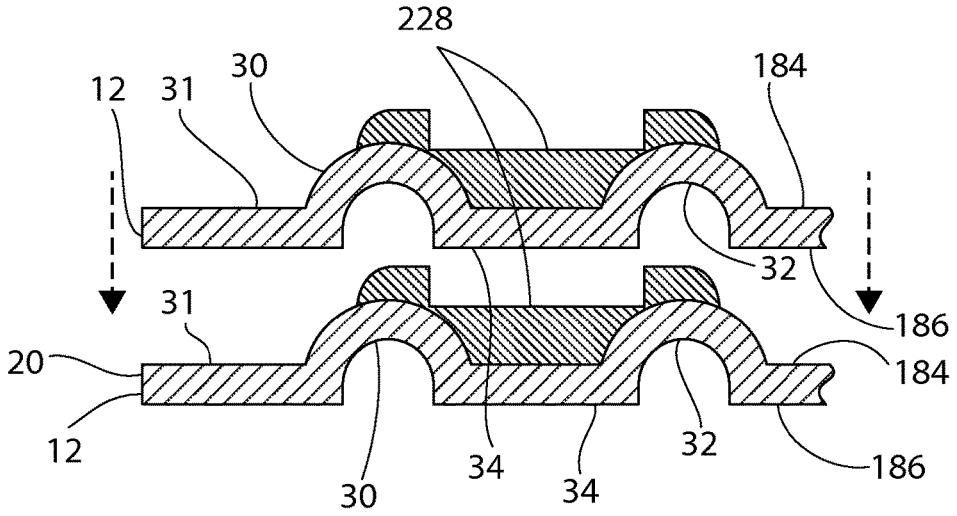
FIG. 14 is a view similar to the view of FIG. 13 showing one plate moving toward another plate to illustrate a non-limiting embodiment of a stacking arrangement of the invention.

With reference to FIGS. 10, 13, and 14, a stacking groove 228 is provided between the outer rib member 30 and the inner rib member 32. In the non-limiting embodiment of the invention shown in FIGS. 10, 13, and 14, each of the four stacking grooves 228 is aligned with one of the four radiused corners 20-23 of the plate 180. As can be appreciated, the invention is not limited to the number or location of the stacking grooves 228 and the invention contemplates, but is not limited to, any number, e.g., 2, 3, 5, 10, of spaced stacking grooves 228, and the stacking grooves can be located at any position between the outer rib member 30 and the inner rib member 32, or between the sides 12-15 of the rib plate 180 and the outer rib member 30.

The invention is not limited to the forming of the stacking grooves, and the stacking grooves can be formed in any manner, e.g. but not limiting to the invention, forming the rib plate and thereafter filling in the space between the outer rib member 30 and the inner rib member 32 and forming the groove 228 (see cross-sectional lines in FIG. 13), or forming the plate and the stacking groove in one pressing operation (see cross-sectional lines in FIG. 14). The invention is not limited to the size of the groove 228 and, in the preferred practice of the invention, the stacking groove 228 is sized to receive the flat portion 34 between the inner and outer rib members 30, 34 as shown in FIG. 14. In the non-limiting embodiment of the invention, the stacking groove had a width of 0.25 inch. As can be appreciated, the material between the outer and the inner rib members 30, 34 to form the stacking grooves 228 has a dual function of strengthening the plate 180 and providing for stacking the plates.

Miscellaneous Non-Limiting Embodiments of the Bearing Plate of the Invention

As can now be appreciated, the invention is not limited to the material of the bearing plates 10 (FIGS. 1-5), 80 (FIGS. 6-9), and 180 (FIGS. 10-14), and the bearing plates can be made of any material, e.g. but not limited to, metal, plastic, and fiber reinforced plastic. In one embodiment of the invention, the bearing plates 10, 80, and 180 are used in rib and roof support systems for coal mines where the extracted coal is processed to make powdered coal. As discussed above, the impurities removed during the washing of the coal chunks include the ground particles of the bearing plates. In view of the foregoing, the bearing plates 10, 80 and 180 are made of a non-metal material, e.g. but not limited to, fiberglass reinforced plastic having a specific gravity of 1.7 designed for coal processing plants. In one embodiment of the invention, the bearing plates 10, 80, and 180 are made placing mats of polyester resin fiberglass (e.g. but not limited to, E-glass fibers) between mold dies, and applying heat and pressure to the dies to form the bearing plates having a density of 2.54 grams/cubic centimeter.

Figure 15:
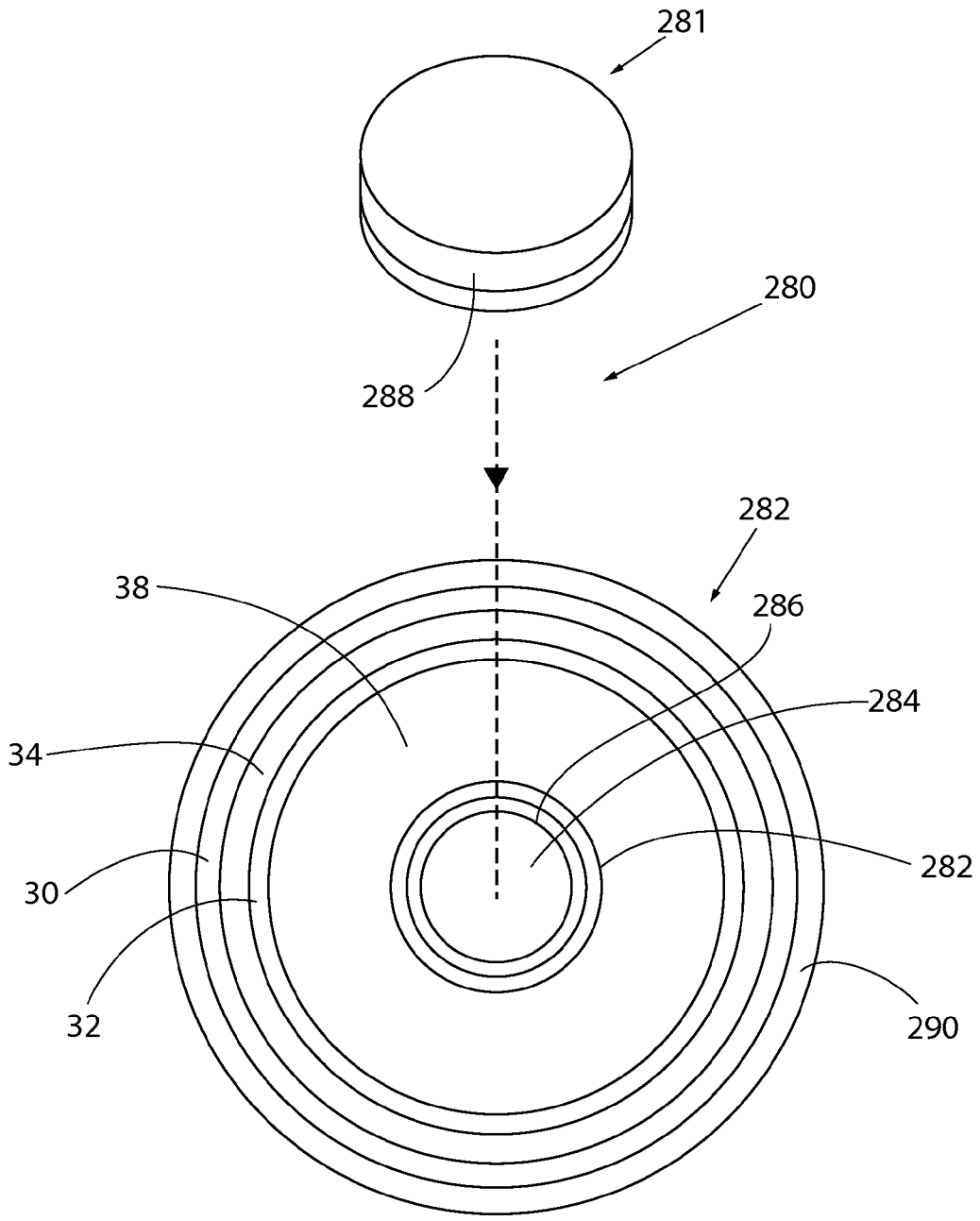
FIG. 15 is an exploded view of a two-part rib and roof plate showing a support substrate and a strengthened center portion or segment.

The invention contemplates making a one-piece bearing plate and a bearing plate made of joined pieces of the bearing plate. Examples of a one-piece bearing plate are shown in FIGS. 1-14, and an example of a bearing plate made of joined pieces is shown in FIG. 15. The bearing plate 280 shown in FIG. 15 includes a strengthened center portion or segment 281, which includes, but is not limited to, the strengthened center portion or segment 40 (see FIG. 1), the strengthened center portion or segment 82 (see FIG. 6), or the strengthened center portion or segment 182 (see FIG. 12), and a support substrate 282. The support substrate 282 can have a circular shape as shown in FIG. 15 or a square shape as shown in FIGS. 1, 6, and 10, or any other shape as discussed above. The support substrate 282 includes the outer rib member 30, the inner rib member 32, the flat surface portion 34 between the outer and inner rib members 30, 32, and the flat surface portion 38 between the inner rib member 32 and a hole 284 having a stepped support ledge 286. The periphery of the strengthened portion 281 has a stepped ledge 288 that is sized and a mirror image of the support ledge 286 of the support substrate 282 to engage the support ledge 286 of the support substrate 282 to provide the two-part bearing plate 280. The bearing plate 280 is mounted on the rib or roof of a mine with surface 290 of the support substrate 282 facing away from the rib or roof.

The invention is not limited to the process of manufacturing the fiberglass bearing plate 10 (FIGS. 1-5), bearing plate 80 (FIGS. 6-9), the bearing plate 180 (FIGS. 10-14), and the bearing plate 280 (FIG. 15), and any of the processes known in the art for forming an article using fiberglass reinforced plastic can be used in the practice of the invention.

Non-Limiting Embodiments of a Nut and Bolt Assembly of the Invention

Figure 16:
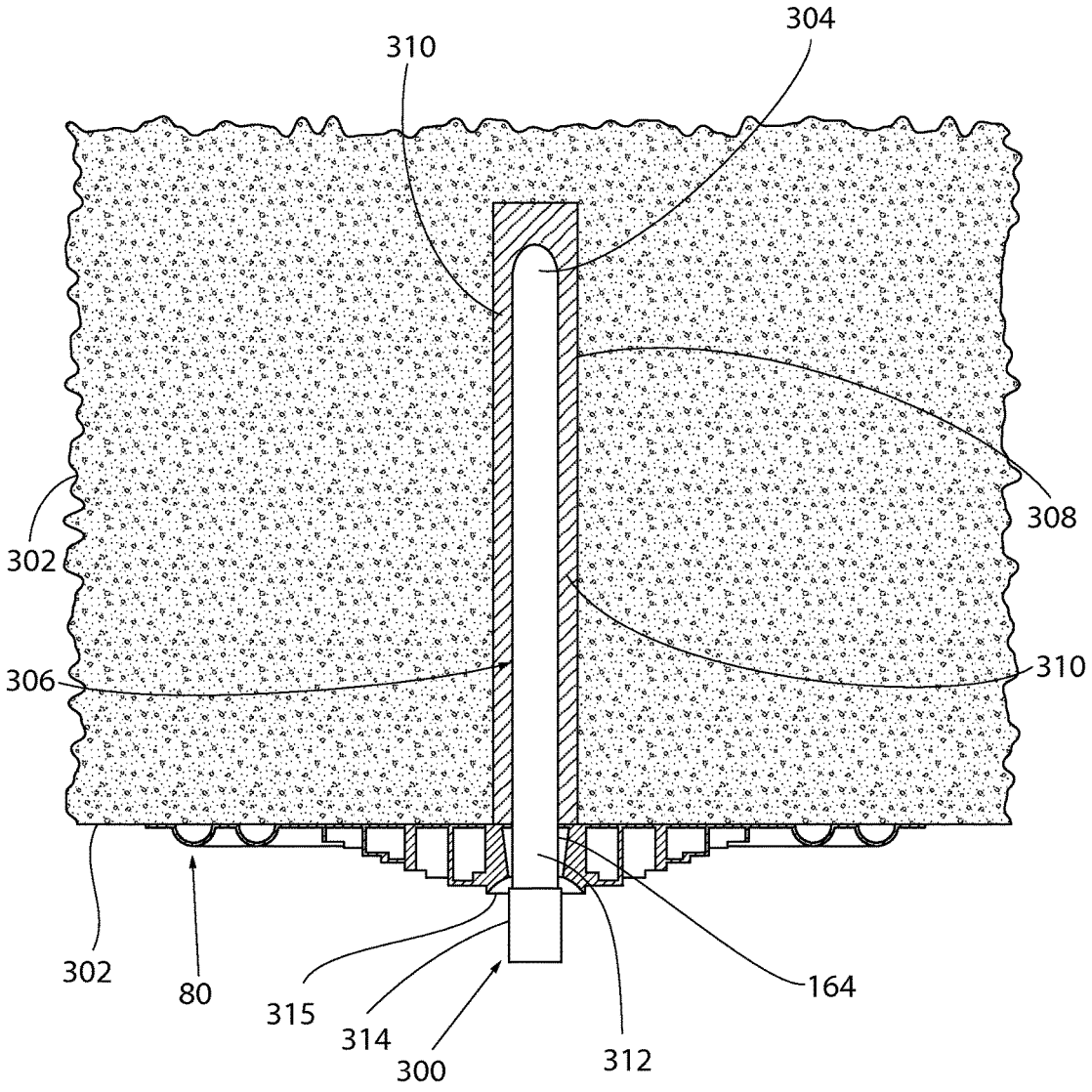
FIG. 16 is a sectional view of a roof of a coal mine showing the rib and roof plate of FIG. 6 securely mounted to the roof of a mine in accordance to the invention.

The invention is not limited to the design of the nut and bolt assembly that can be used to securely mount the bearing plates 10 (FIG. 1), 80 (FIG. 6), and 180 (FIG. 10) of the invention to a rib (sidewall) or roof of a mine. With reference to FIG. 16, there is shown a non-limiting embodiment of a nut and bolt assembly 300 of the invention for biasing the bearing plate 10 (FIG. 1), 80 (FIG. 6), and 180 (FIG. 10) against a roof 302 of a mine (see FIG. 16). A first end portion 304 of bolt 306 of the nut and bolt assembly 300 is secured in the passageway 308 of the roof 302 by cured resin 310, as is known in the art. Opposite second end portion 312 of the bolt 306 passes through the bolthole 164 of the plate 80. A nut 314 and spherical washer 315 are positioned on the second end 312 of the bolt 306, and the plate 80 is biased against the roof 302 by rotating the nut 314 threaded on the second end portion 312 of the bolt 306 of the nut and bolt assembly 300.

The design of the nut 314 is not limiting to the invention and the nut can be any of the types used in the art, e.g. but not limited to, the nut 314 having a breakaway plastic insert 316 (shown in FIG. 17) disclosed in U.S. Patent Application Publication No. 2006/0210374 A1 and in U.S. Patent Application Publication No. 2011/0268526 A1, which documents are hereby incorporated by reference. In practice, the nut 314 having the insert 316 is threaded onto the second end portion 312 of the bolt 306 to move the insert 316 against the second end portion 312 of the bolt 306. Upon engagement of the insert 316 of the nut 314 and the bolt 306, the bolt 306 is rotated to mix the resin 310 (see FIG. 16). When the resin 310 sets, continued rotation of the nut 314 breaks the insert 316 and moves the nut 314 along the second end portion 312 of the bolt 306 to move the bearing plate 10 (FIG. 1), 80 (FIG. 6), and 180 (FIG. 10) against the ceiling or sidewall 302 of the mine (see FIG. 16).

The nut 314 and the bolt 306 of the nut and bolt assembly 300 can be made of any material, e.g. but not limited to, metal, plastic or fiberglass reinforced plastic. In the preferred practice of the invention, the nut 314 and the bolt 306 of the nut and bolt assembly 300 were made of fiberglass reinforced plastic designed at 1.7 specific gravity for coal processing plants.

Figure 17:
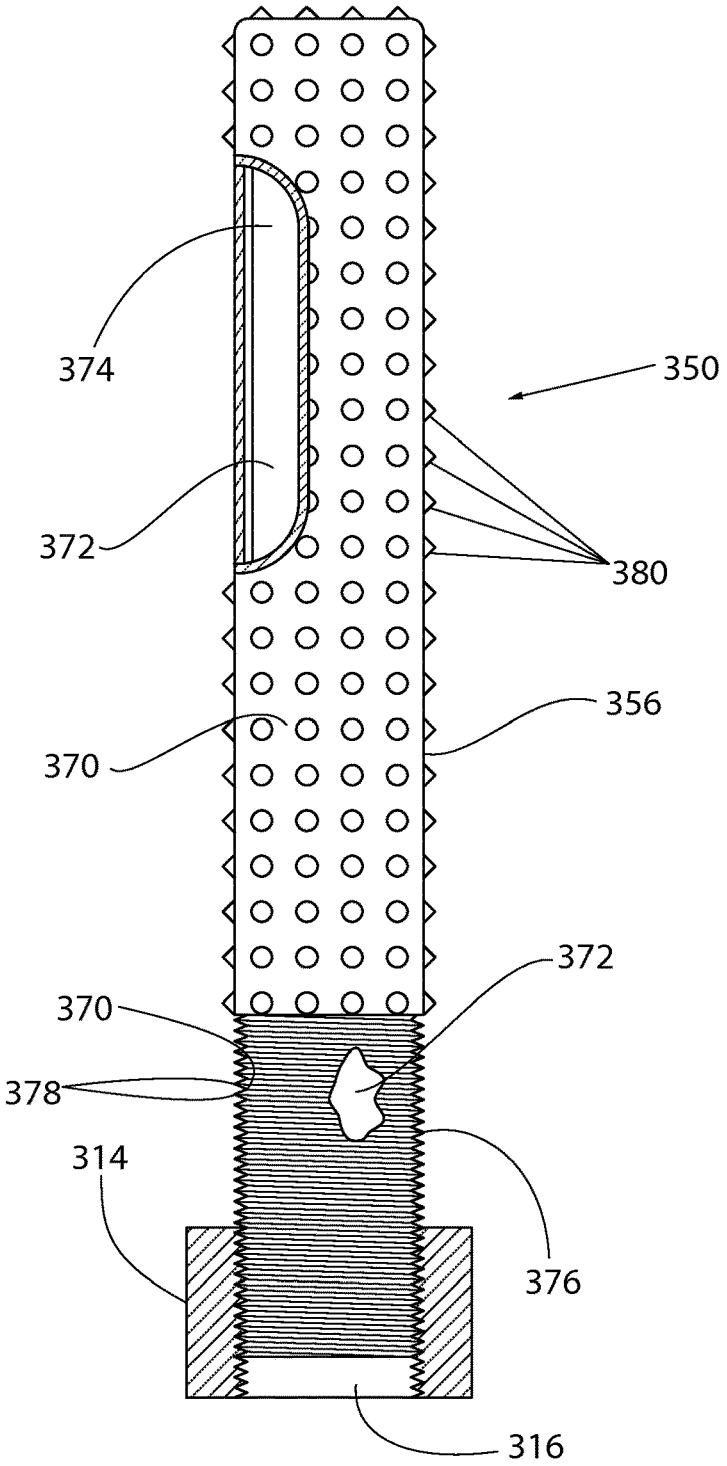
FIG. 17 is a side elevated view having portions removed for purposes of clarity of a non-limiting embodiment of a nut and bolt assembly of the invention.
Figure 18:
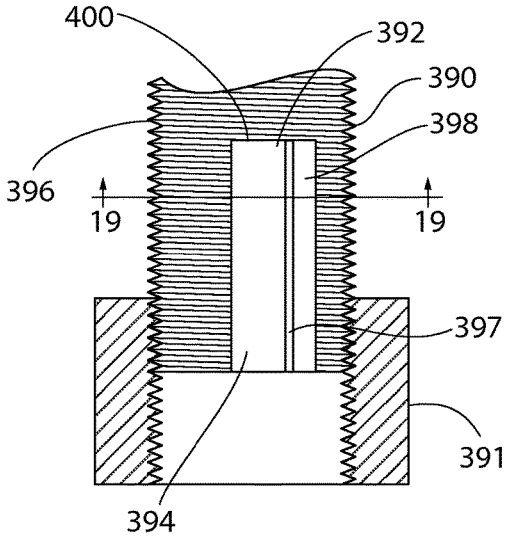
FIG. 18 is a side elevated view of a bolt and nut arrangement of the invention with the nut in cross section.

With reference to FIG. 17, the discussion is now directed to nut and bolt assembly 350 of the invention. Bolt 356 of the assembly 350 had a coating 370 of glass reinforced nylon over a core or rebar 372 cut from a pultruded composite circular member (not shown) of polyester resin fiberglass. The coating 370 was applied over the core 372 to cover a first end portion 374 of the rebar 372 with the coating 370 having raised deformations 380 to facilitate the mixing of the resin 310 (see FIG. 16), and to cover a second end portion 376 of the rebar 372 with threads 378 to receive the nut 314. The invention is not limited to the method of applying the glass reinforced nylon to the rebar 372 and any method known in the art, e.g. but not limited to, the method disclosed in U.S. Patent Application Publication No. 2011/0052332, which document is hereby incorporated herein by reference. The length of the second end portion 376 of the bolt 356 (see FIG. 17) was about 10-15% of the total length of the bolt 356. Attachment 1 of U.S. Provisional Patent Application No. 61/601,731 filed Feb. 22, 2012 discloses additional details of the non-limiting embodiment of the bolt 356 shown in FIG. 17.

The discussion is now directed to a non-limiting embodiment of a bolt 390 of the invention (FIGS. 18-21) that uses an arrangement (hereinafter also referred to as a "clutch") discussed in detail below to simultaneously rotate the bolt 390 and the nut 391 when the nut 391 is rotated in a first direction, and to apply torque to the nut 391 when the nut 391 is rotated in an opposite second direction. In the following discussion, the bolt 390 will be discussed for use with the nut 391 with the understanding that the discussion is applicable, unless indicated otherwise, to the nut and bolt assembly 300 shown in FIG. 16 and the nut and bolt assembly 350 shown in FIG. 17.

Figure 19:
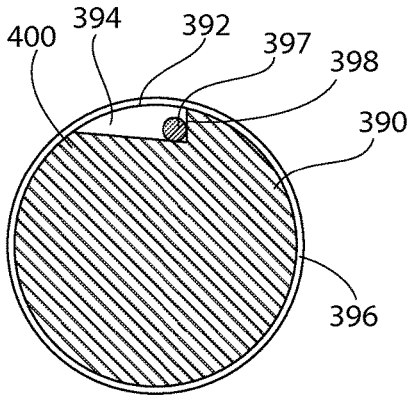
FIG. 19 is a view taken along line 19-19 of FIG. 18.
Figure 20:
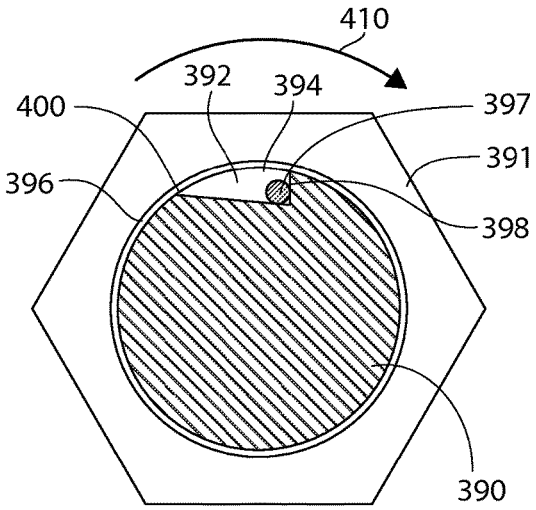
FIG. 20 is a view similar to the view shown in FIG. 19 having a nut threaded on the bolt and arranged to move the bolt in a clockwise direction.
Figure 21:
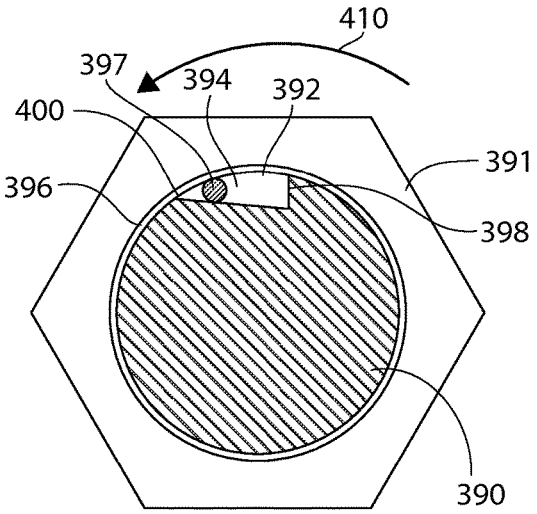
FIG. 21 is a view similar to the view shown in FIG. 19 having a nut threaded on the bolt and arranged to move the bolt in a counterclockwise direction.

With reference to FIGS. 18-21 as needed, there is shown a non-limited embodiment of a threaded end of a bolt 390 of the invention having a clutch 392. The clutch 392 included a channel 394 cut into threaded surface 386 of the bolt 390, and a threaded shaft 397. As shown in FIGS. 19-21, side 398 of the channel 394 is cut deeper into the threaded surface 396 of the bolt 390 than side 400 of the channel 394. More particularly, the side 400 of the channel 394 is flush with the threaded surface 396 of the bolt 390, and the side 398 of the channel 394 has a height as measured from the threaded surface 396 of the bolt 390 greater than the diameter of the threaded shaft 397. In one non-limited embodiment of the invention, the threaded shaft 397 had 8-32 threads and a diameter of ⅛ inch. The side 398 of the channel had a depth of 5/32 inch, a width of ½ inch, and a length of 2.5 inches.

With reference to FIGS. 20 and 21, as the nut 390 is rotated in the direction of the arrowed lead line 412, (a counterclockwise direction as viewed in FIG. 21), the threaded shaft 408 in the channel 394 is moved toward the side 400 of the channel 394, which causes the nut 390, the shaft 397, and the bolt 390 to bind such that rotation of the nut 391 in the direction of the arrowed line 412 simultaneously rotates the bolt 390 and the nut 391 to mix the resin 310 (FIG. 16). As the nut 391 is rotated in the direction of the arrowed lead line 410 (FIG. 20), (a clockwise direction), the threaded shaft 397 in the channel 394 is moved toward the side 398 of the channel 394. As discussed above, the diameter of the threaded shaft 397 is less than the height of the sidewall 398, which passes threads 414 of the bolt 390 over the shaft 397 to apply torque to the nut 391 to thread the nut 391 on the bolt 356 (see FIG. 17) to move the bearing plate toward the roof or sidewall of the mine. In another non-limiting embodiment of the invention, the bolt 390, the nut 391, and the shaft 397 are made of plastic and were designed at 1.7 specific gravity for coal processing plants.

The nut 391 and the bolt 390 are shipped by placing the threaded shaft in the channel 394 and threading the nut 391 on the bolt 390 covering the channel 304 and the threaded shaft 397. Attachment 1 of U.S. Provisional Patent Application No. 61/601,731 filed Feb. 22, 2012 discloses additional details of the non-limiting embodiment of the clutch 392.

The invention is not limited to the embodiments of the invention presented and discussed above which are presented for illustration purposes only. Further, it will be readily appreciated by those skilled in the art that modifications can be made to the non-limiting embodiments of the invention discussed herein without departing from the concepts disclosed in the foregoing description. Accordingly, the particular non-limiting embodiments of the invention described in detail herein are illustrative only and are not limiting to the scope of the invention, which is to be given the full breadth of the appended claims and any and all equivalents thereof.

The invention claimed is:

1. A bearing plate having a first major surface and an opposite second major surface for contacting a roof or a rib of a mine, the bearing plate comprising:

an outer reinforced area surrounding an inner reinforced area, wherein the outer reinforced area comprises one or more endless rib members between the inner reinforced area and a peripheral edge of the bearing plate; and the inner reinforced area comprises a member forming a portion of a hemisphere that extends from the first major surface to an opening of a bolthole substantially positioned in a center of the plate, the member being concave in shape when viewed from the second major surface and a plurality of legs, each leg having a first end and an opposite second end spaced from the first end, wherein the legs are spaced from one another and the first end of each leg encircles the bolthole, and wherein the first end is at a higher elevation than the second end of the legs when measured from the first surface of the bearing plate, wherein the first major surface extends from the peripheral edge of the bearing plate, wherein at least one stacking groove comprising a substantially flat surface spaced apart from the first major surface of the bearing plate, and wherein the inner reinforced area is surrounded by a first flat portion of the bearing plate, wherein the first flat portion is between the outer reinforced area and the inner reinforced area, the member having an outer surface and an inner surface, and wherein a diameter of the outer surface decreases as the distance from the first flat portion increases and terminates at one boundary of a transition portion that forms an opening for a passageway and the inner surface of the member has a diameter that decreases as the distance from the second surface of the bearing plate increases and terminates at a second boundary of the transition portion opposite to the first boundary of the transition portion.

2. The bearing plate according to claim 1, wherein the inner reinforced area is surrounded by a first flat portion of the bearing plate, wherein the first flat portion is between the outer reinforced area and the inner reinforced area wherein elevation of the member terminates in a flat circular surface, and wherein an inner surface of the hemispherical member comprises a sloping surface extending from the first circular surface to opening a bolthole.

3. The bearing plate according to claim 2, wherein the first end of each of the plurality of legs terminates at the flat circular surface.

4. The bearing plate according to claim 3, wherein the outer reinforced area comprises an outer endless concave rib member spaced from peripheral edge of the bearing plate, and an inner concave rib member spaced from the outer concave rib member and between the outer endless concave rib member and the first flat portion, wherein the inner and the outer endless concave rib members have a convex shape when viewed from the first major surface of the bearing plate and have a concave surface when viewed from the second major surface of the bearing plate; the plurality of legs comprises four legs, and width of the legs at a position between the first end and the second end of the legs is greater than the width of the first end and the second end of the legs.

5. The bearing plate according to claim 4, wherein the bearing plate is made of plastic and fiberglass, and has a specific gravity in the range of 1.5-1.9.

6. The bearing plate according to claim 1, wherein the transition portion of the member has a first segment having a decreasing diameter as the distance from the first boundary increases and a second segment extending from the first segment to the second boundary, the second segment of the transition portion having a constant diameter.

7. The bearing plate according to claim 6, wherein the first end of the plurality of legs overlays the outer surface of the member spaced from the first boundary of the transition portion.

8. The bearing plate according to claim 7, wherein the plurality of legs comprise eight equally spaced legs.

9. The bearing plate according to claim 8, wherein the outer reinforced area comprises an outer endless concave rib member spaced from peripheral edge of the bearing plate, and an inner concave rib member spaced from the outer concave rib member and between the outer endless concave rib member and the first flat portion, wherein the inner and the outer endless concave rib members have a convex shape when viewed from the first major surface of the bearing plate and have a concave surface when viewed from the second major surface of the bearing plate; the plurality of legs comprises four legs, and width of the legs at a position between the first end and the second end of the legs is greater than the width of the first end, and the inner and the outer rib members are spaced from one another by a second flat portion.

10. The bearing plate according to claim 9, wherein the bearing plate is made of plastic and fiberglass, and has a specific gravity in the range of 1.5-1.9.

11. The bearing plate according to claim 1, wherein the outer reinforced area comprises an outer endless rib member spaced from peripheral edge of the bearing plate, and an inner rib member spaced from the outer rib member and between the outer endless rib member and the first flat portion, wherein the inner and the outer endless rib members have a convex shape when viewed from the first major surface of the bearing plate and have a concave surface when viewed from the second major surface of the bearing plate, and a stacking groove between the outer and inner rib members, and wherein the stacking groove comprises a groove formed in a surface of a block of material, the block mounted on the first surface of the bearing plate between the outer and inner rib members with the groove facing away from the first major surface of the bearing plate.

12. The bearing plate according to claim 11, wherein the stacking groove comprises four stacking grooves, with the block of material of the stacking grooves mounted between the inner and the outer rib members.

13. The bearing plate according to claim 1, wherein the bearing plate is made of fiberglass reinforced plastic.

14. The bearing plate according to claim 1, wherein the bearing plate is a component of a support safety device, the support safety device further comprising a nut and bolt assembly comprising a bolt sized to pass through the hole of the bearing plate, and wherein the bearing plate and the nut and bolt assembly are made of fiberglass reinforced plastic having a designated specific gravity in the range of 1.5 to 1.9.

15. A bearing plate for mine roof or rib support having a first major surface and an opposite second major surface for contacting a mine roof or rib, the bearing plate comprising:

an outer reinforced area surrounding an inner reinforced area, wherein the outer reinforced area comprises one or more endless rib members between the inner reinforced area and peripheral edge of the bearing plate; and the inner reinforced area defining a bolthole extending through the bearing plate and comprising a plurality of circular steps having a concentric center, the plurality of circular steps being substantially parallel with the first major surface, wherein a height of a step adjacent to the concentric center is greater than a height of a step spaced from the concentric center, wherein selected ones of the steps have a first plurality of cavities and a second plurality of cavities, wherein the first plurality of cavities has an open end at the first side of the bearing plate and the second plurality of cavities has an open end at the second surface of the bearing plate, and each one of the first cavities is between two adjacent ones of the second plurality of cavities.

16. The bearing plate according to claim 15, wherein the bearing plate is made of fiberglass reinforced plastic.

* * * * *